US006984789B2

(12) United States Patent
Glaser et al.

(10) Patent No.: US 6,984,789 B2
(45) Date of Patent: Jan. 10, 2006

(54) ELECTRICAL CABLE AND METHOD OF MAKING

(75) Inventors: John Stanley Glaser, Niskayuna, NY (US); Judson Sloan Marte, Wynantskill, NY (US); Canan Uslu Hardwicke, Niskayuna, NY (US); Michael Andrew De Rooij, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 10/776,277

(22) Filed: Feb. 12, 2004

(65) Prior Publication Data

US 2004/0159459 A1 Aug. 19, 2004

Related U.S. Application Data

(62) Division of application No. 10/336,869, filed on Jan. 7, 2003, now Pat. No. 6,735,862.

(51) Int. Cl.
*H01B 7/08* (2006.01)

(52) U.S. Cl. ..... 174/117 F

(58) Field of Classification Search ..... 174/117 F, 174/117 FF, 117 A, 36
See application file for complete search history.

(56) References Cited

U.S. PATENT DOCUMENTS

| | | | | |
|---|---|---|---|---|
| 4,095,326 | A | 6/1978 | Harvey | |
| 4,208,542 | A * | 6/1980 | Endo | 174/113 C |
| 4,443,277 | A * | 4/1984 | Rokas | 156/50 |
| 4,719,319 | A * | 1/1988 | Tighe, Jr. | 174/103 |
| 4,780,157 | A * | 10/1988 | Coon | 156/53 |
| 4,887,354 | A | 12/1989 | Van Der Maaden | |
| 5,500,489 | A * | 3/1996 | Shah et al. | 174/117 FF |
| 5,516,986 | A * | 5/1996 | Peterson et al. | 174/113 C |
| 5,552,565 | A * | 9/1996 | Cartier et al. | 174/117 F |
| 6,215,062 | B1 * | 4/2001 | Kimber | 174/27 |
| 2002/0046870 | A1 * | 4/2002 | Zein et al. | 174/117 F |

* cited by examiner

*Primary Examiner*—Chau N. Nguyen
(74) *Attorney, Agent, or Firm*—Fletcher Yoder

(57) ABSTRACT

A method of making an electrical cable, the method comprising: bonding a plurality of electrical conductors to respective neighboring ones of the electrical conductors to form a ribbon, the electrical conductors being electrically insulated from the respective neighboring ones; folding the ribbon to form cable assembly, each of the electrical conductors traversing the width of the cable assembly at least twice; optionally bonding the cable assembly; and optionally coiling the cable assembly.

36 Claims, 5 Drawing Sheets

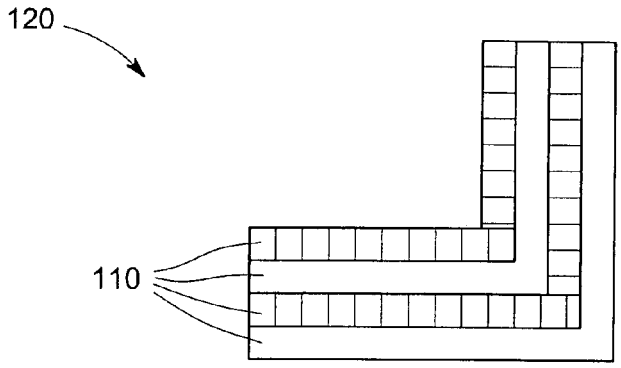
FIG.7
FIG.8
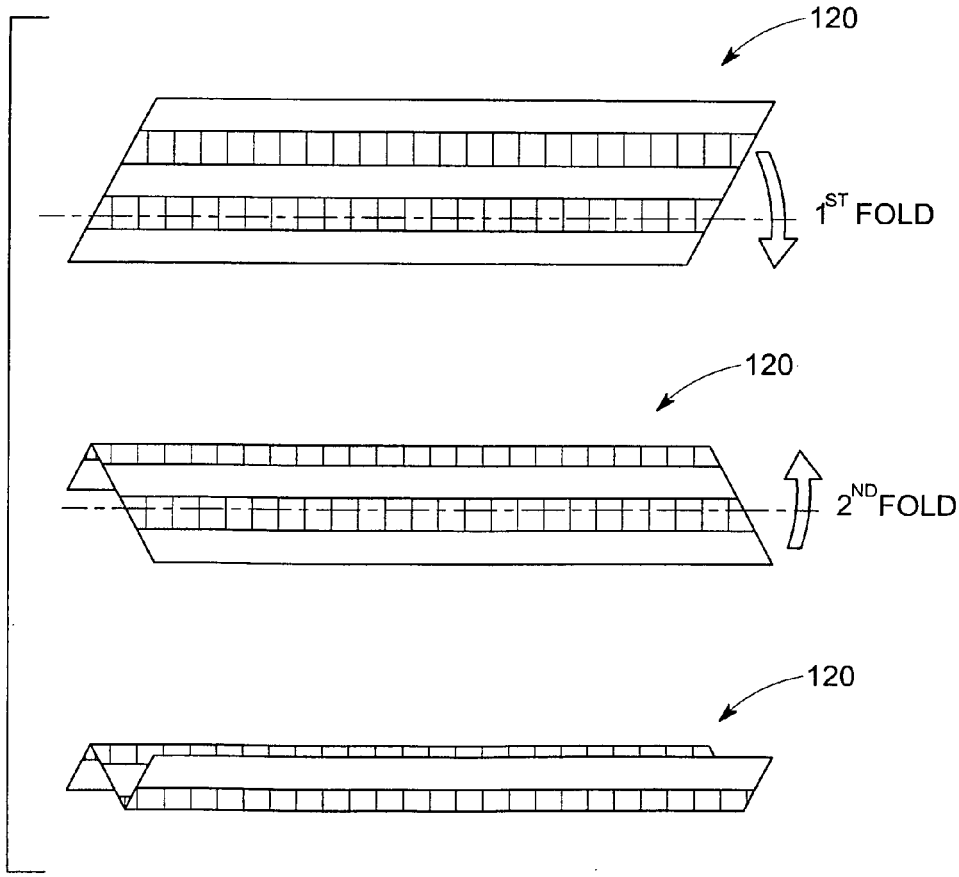

ELECTRICAL CABLE AND METHOD OF MAKING

CROSS REFERENCE TO RELATED APPLICATIONS

This application is a divisional of Ser. No. 10/336,869, now U.S. Pat. No. 6,735,862, entitled "METHOD OF MAKING ELECTRICAL CABLE", filed on Jan. 7, 2003.

BACKGROUND

The present invention relates generally to the field of electrical cables and more specifically to the field of making litz wire.

In a wide variety of applications, litz wire (also called "litzendraht wire") is used to reduce the high frequency impedance of electrical cables. A typical litz wire consists of a number of individually insulated conductors woven together so that each conductor assumes all possible positions in the cross section of the assembly. This arrangement of the conductors tends to reduce high frequency eddy current effects, thereby resulting in lower high frequency impedance.

The woven litz wire, while providing high performance, is sometimes prohibitively expensive for some applications owing to difficulty in its manufacture. Opportunities exist, therefore, to reduce the cost of litz wire and expand the number of applications by finding an alternative, less costly method of manufacture.

SUMMARY

The opportunities described above are addressed, in one embodiment of the present invention, by a method of making an electrical cable, the method comprising: bonding a plurality of electrical conductors to respective neighboring ones of the electrical conductors to form a ribbon, the electrical conductors being electrically insulated from the respective neighboring ones; folding the ribbon to form a cable assembly, each of the electrical conductors traversing the width of the cable assembly at least twice; optionally bonding the cable assembly; and optionally coiling the cable assembly.

DRAWINGS

These and other features, aspects, and advantages of the present invention will become better understood when the following detailed description is read with reference to the accompanying drawings in which like characters represent like parts throughout the drawings, wherein:

FIG. 7 illustrates an orthographic view of a cable assembly bended to form a corner in accordance with one embodiment of the present invention.

FIG. 8 illustrates an orthographic view of a cable assembly folded lengthwise in accordance with another embodiment of the present invention.

DETAILED DESCRIPTION

Figure 1:
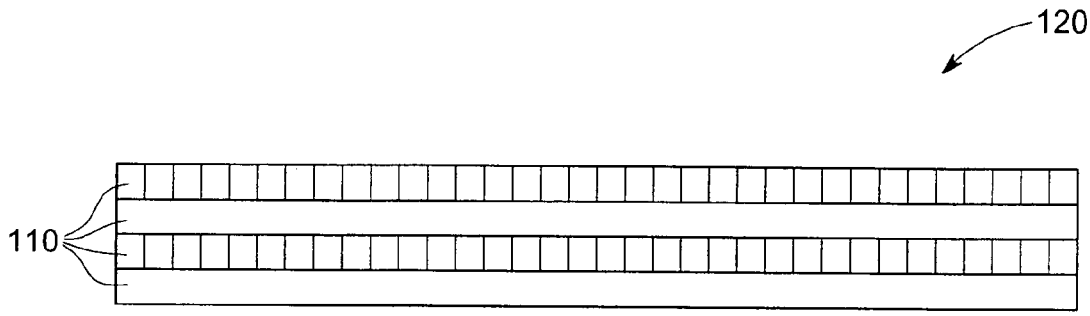
FIG. 1 illustrates an orthographic view of a ribbon in accordance with one embodiment of the present invention.
Figure 2:
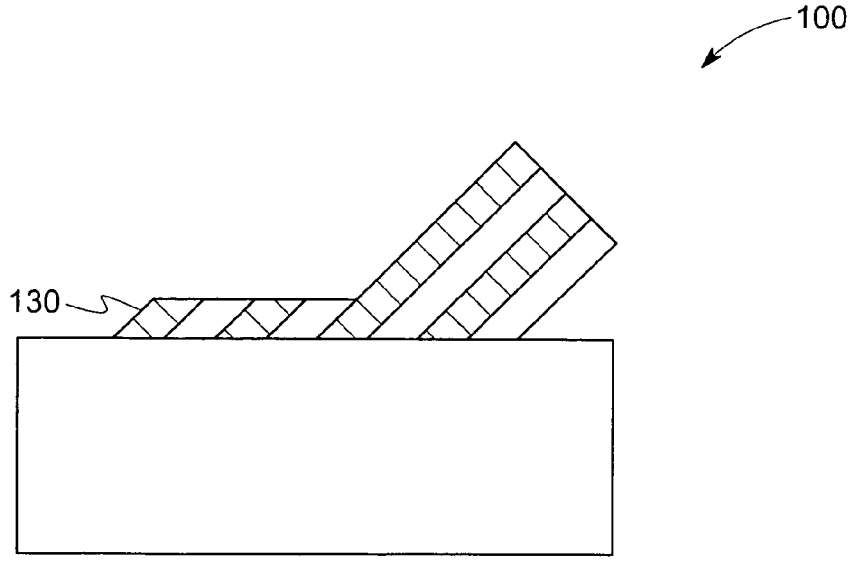
FIG. 2 illustrates an orthographic view of an electrical cable in accordance with the embodiment of FIG. 1.

In accordance with one embodiment of the present invention, FIG. 1 illustrates an orthographic view of a ribbon 120. A method of making an electrical cable starts by bonding a plurality of electrical conductors 110 to respective neighboring ones of electrical conductors 110 to form ribbon 120, where electrical conductors 110 are electrically insulated from their respective neighbors. Ribbon 120 is then folded as shown in FIG. 2 to form cable assembly 130. The folding is performed so that each of electrical conductors 110 traverses the width of cable assembly 130 at least twice. In some embodiments, electrical cable 100 is then completed by bonding cable assembly 130 to hold the folded shape. In some embodiments, such as, for example, in magnetic component applications, electrical cable 100 is completed by coiling cable assembly 130. In some embodiments, coiling cable assembly 130 is facilitated by bending cable assembly 130 to form corners during the act of folding as illustrated in FIG. 7.

In another embodiment of the present invention, cable assembly 130 is folded such that electrical conductors 110 do not describe spirals around cable assembly 130.

In another embodiment of the present invention, cable assembly 130 is folded lengthwise before bonding to produce a thicker cable as illustrated in FIG. 8.

Figure 3:
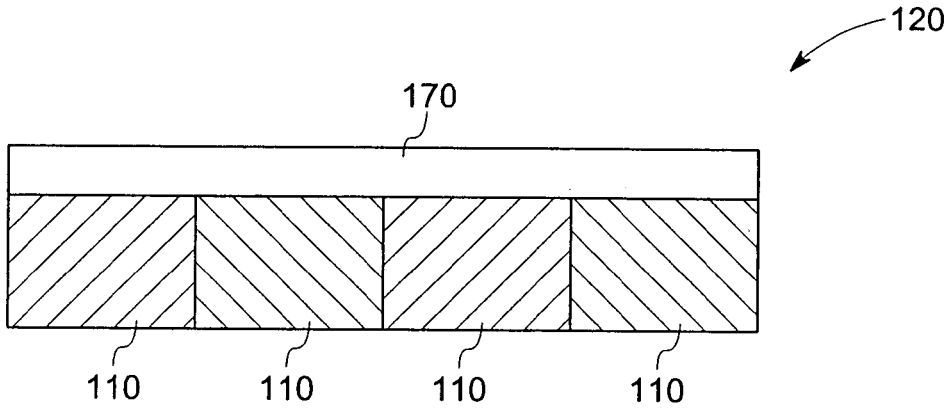
FIG. 3 illustrates an orthographic view of a ribbon in accordance with another embodiment of the present invention.

In another embodiment of the present invention, FIG. 3 illustrates a bonding layer 170 applied to ribbon 120 prior to folding. In some embodiments, bonding layer 170 is electrically insulating. Examples of bonding layer 170 include, without limitation, adhesives and curable polymers.

In another embodiment of the present invention, bonding layer 170 is cured by exposure to a bonding stimulus. Examples of bonding stimuli include, without limitation, electromagnetic radiation, mechanical stimuli, and chemical stimuli.

Figure 4:
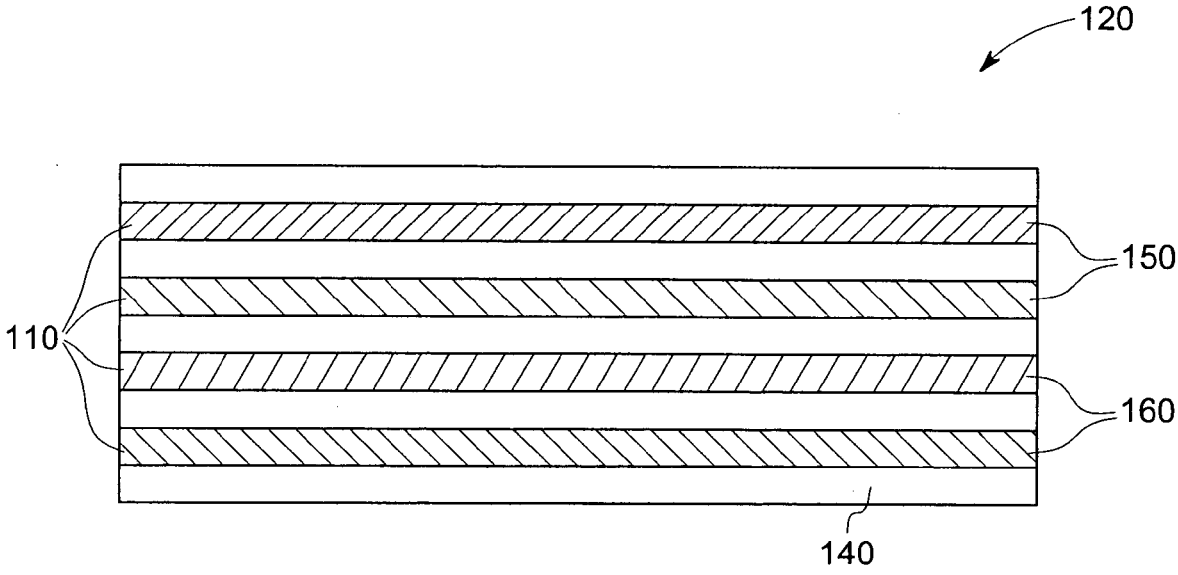
FIG. 4 illustrates an orthographic view of a ribbon in accordance with another embodiment of the present invention.

FIG. 4 illustrates ribbon 120 in accordance with another embodiment of the present invention. In the embodiment of FIG. 4, bonding each of electrical conductors 110 to a respective neighbor is accomplished by bonding the plurality of electrical conductors 110 to a common cable substrate 140. In some embodiments, cable substrate 140 is electrically insulating. In some embodiments, electrical conductors 110 are spaced apart from their respective neighbors.

Figure 9:
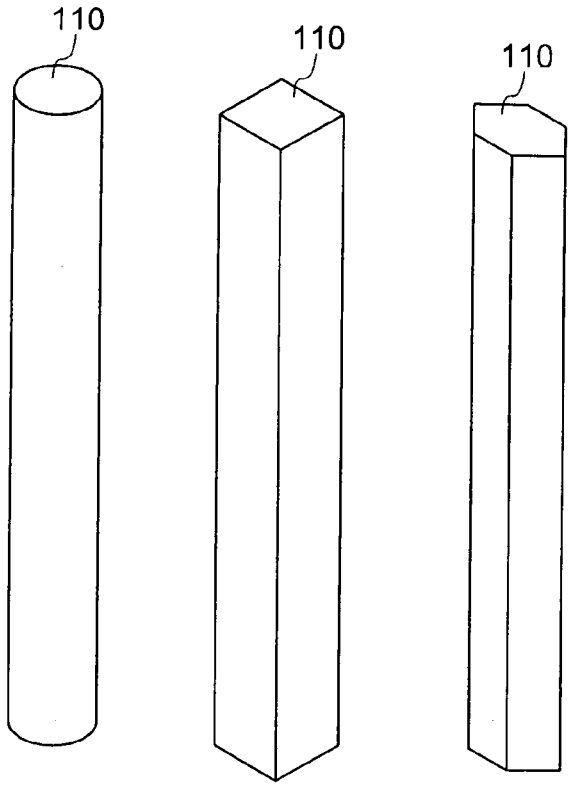
FIG. 9 illustrates an orthographic view of an electrical conductor having various cross section lengthwise in accordance with one embodiment of the present invention.

In another embodiment, each of electrical conductors 110 has a non-rectangular cross section as illustrated in FIG. 9. By way of example, but not limitation, circular cross sections may be used. In some embodiments, ribbon 120 is further processed by being rolled flat prior to being folded.

Figure 10:
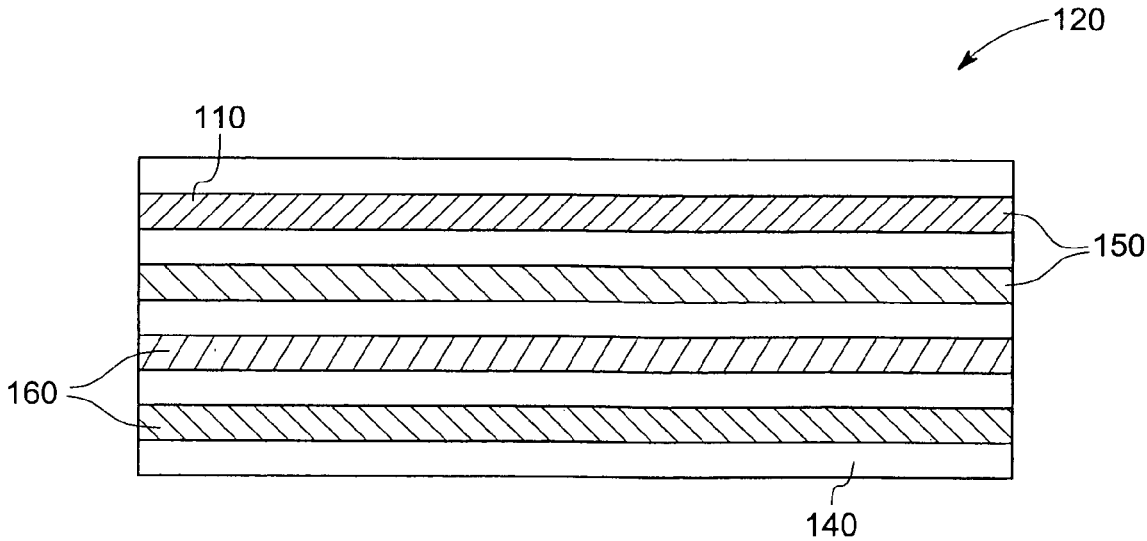
FIG. 10 illustrates an orthographic view of a ribbon in accordance with another embodiment of the present invention.

In another embodiment, illustrated in FIG. 4, the capacitance of electrical cable 100 is influenced by selectively coupling electrical conductors 110. At a first end of cable assembly 130, a subset of electrical conductors 110 is electrically coupled to produce a first coupled subset 150, leaving an uncoupled remainder of electrical conductors 110. The uncoupled remainder of electrical conductors 110 are then electrically coupled at a second end of cable assembly 130 to produce a second coupled subset 160. In some embodiments, the first end and second end are at the same end of cable assembly 130. In other embodiments, the first end and second end are at opposite ends of cable assembly 130 as illustrated in FIG. 10.

In another embodiment in accordance with the embodiment of FIG. 4, members of first coupled subset 150 have different respective lengths. Members of second coupled subset 160 have lengths in one-to-one correspondence with the different respective lengths of the members of first coupled subset 150. By varying the lengths of electrical conductors 110 in this embodiment, the capacitance is influenced as a function of length along electrical cable 100, thus influencing the lengthwise current distribution.

In another embodiment in accordance with the embodiment of FIG. 4, a first insulating gap is produced at a first gap location along the length of first coupled subset 150. In some embodiments, a second insulating gap is produced at a second gap location along the length of second coupled subset 160. The first and second insulating gaps also serve to alter overall cable capacitance.

In another embodiment in accordance with FIG. 4, electrical conductors 110 are bonded to opposite faces of cable substrate 140. In another embodiment, after folding, electrical conductors 110 are disposed on an outer surface of cable assembly 130.

Figure 5:
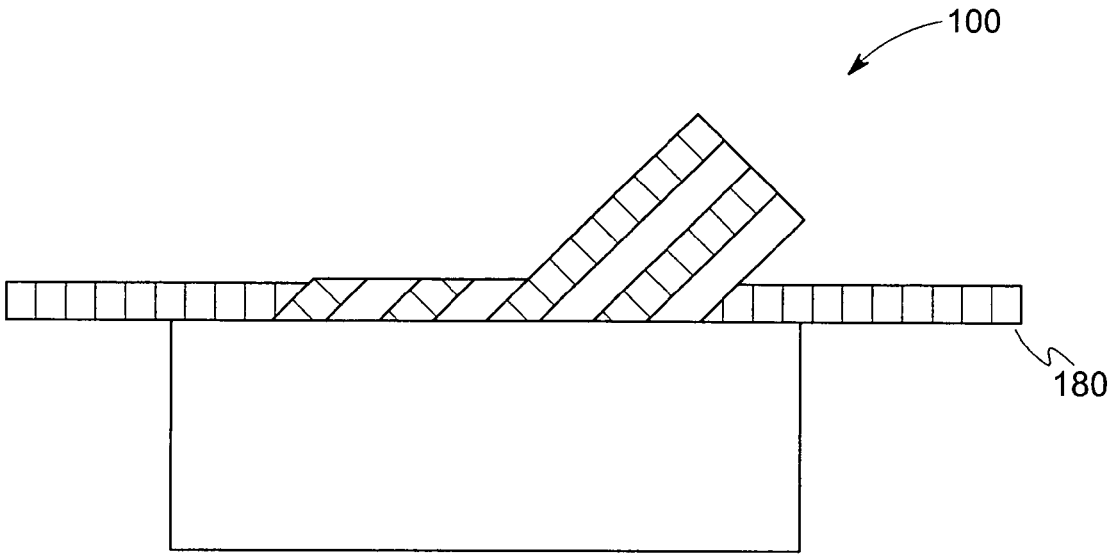
FIG. 5 illustrates an orthographic view of an electrical cable in accordance with another embodiment of the present invention.

FIG. 5 illustrates another embodiment wherein ribbon 120 is folded around an insulating strip 180.

Figure 6:
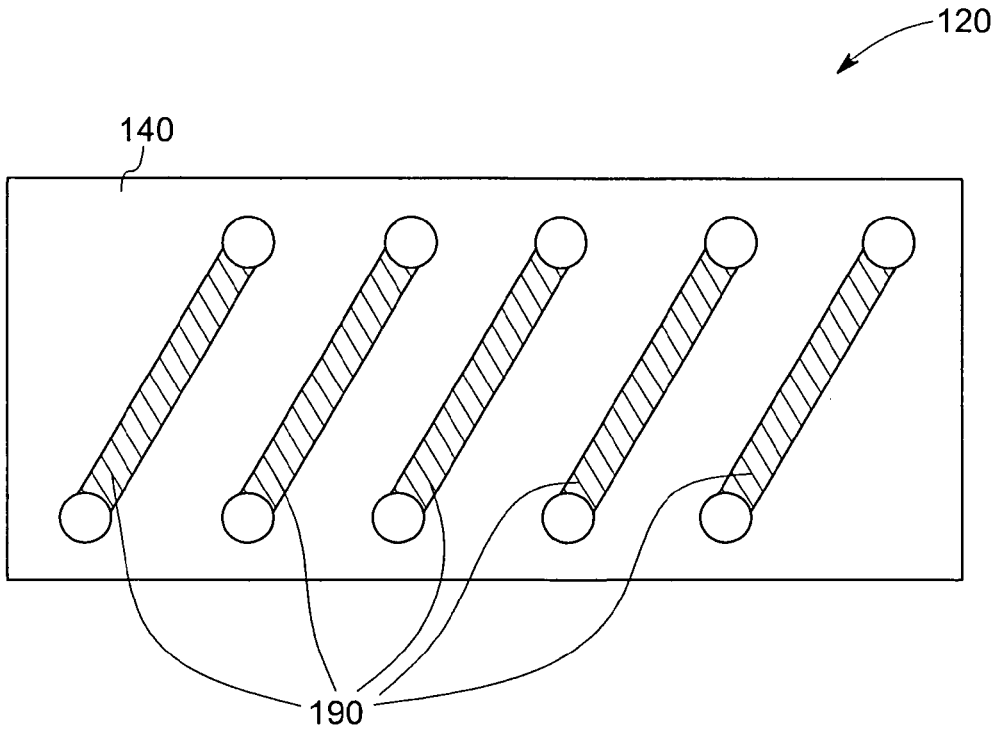
FIG. 6 illustrates an orthographic view of a ribbon in accordance with another embodiment of the present invention.

FIG. 6 illustrates another embodiment wherein electrical conductors 110 are formed into diagonal patterns 190. In another embodiment, diagonal patterns 190 are formed on opposite faces of cable substrate 140 with opposite face pairs of electrical conductors 110 being coupled through coupling holes in cable substrate 140. In another embodiment, opposite face pairs of electrical conductors 110 are coupled at the edges of substrate 140.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. An electrical cable comprising:

a plurality of electrical conductors bonded to respective neighboring ones of said electrical conductors to form a ribbon, said electrical conductors being electrically insulated from said respective neighboring ones, a subset of said electrical conductors being electrically coupled to one another, said ribbon being folded to form cable assembly, each of said electrical conductors traversing the width of said cable assembly at least twice;

wherein said subset of said electrical conductors is electrically coupled at a first end of said cable assembly to produce a first coupled subset leaving an uncoupled remainder of said electrical conductors, and said uncoupled remainder of said electrical conductors is electrically coupled at a second end of said cable assembly to produce a second coupled subset; and members of said first coupled subset have different respective lengths, and members of said second coupled subset have lengths in correspondence with said different respective lengths of said members of said first coupled subset.

2. The electrical cable of claim 1 wherein said electrical conductors do not describe spirals around said cable assembly.

3. The electrical cable of claim 1 wherein said act of folding said ribbon comprises bending said ribbon to form a corner.

4. The electrical cable of claim 1, said cable assembly being folded lengthwise.

5. The electrical cable of claim 1 further comprising a bonding layer disposed on said ribbon, said bonding layer being optionally electrically insulating.

6. The electrical cable of claim 1 further comprising a cable substrate, said plurality of electrical conductors being bonded to said cable substrate.

7. The electrical cable of claim 6 wherein said cable substrate is electrically insulating.

8. The electrical cable of claim 6 wherein said plurality of electrical conductors are spaced apart from said respective neighboring ones.

9. The electrical cable of claim 6 wherein each of said plurality of electrical conductors has a non-rectangular cross section.

10. The electrical cable of claim 6 wherein plurality of electrical conductors are bonded to opposite faces of said cable substrate.

11. The electrical cable of claim 6 wherein said electrical conductors are disposed on an outer surface of said cable assembly.

12. The electrical cable of claim 6 further comprising an insulating strip, said ribbon being folded around said insulating strip.

13. The electrical cable of claim 6 wherein said plurality of electrical conductors form diagonal patterns.

14. The electrical cable of claim 13 wherein:

said diagonal patterns are formed on opposite faces of said cable substrate, opposite face pairs of said electrical conductors being electrically coupled at edges of said cable substrate.

15. The electrical cable of claim 13 wherein:

said diagonal patterns are formed on opposite faces of said cable substrate, said opposite faces of said cable substrate and said electrical conductors having coupling holes therethrough, opposite face pairs of said electrical conductors being electrically coupled through said coupling holes.

16. The electrical cable of claim 6 wherein said plurality of electrical conductors comprise an electrically conducting ink.

17. The electrical cable of claim 1 wherein said first end and said second end are at opposite ends of said cable assembly.

18. The electrical cable of claim 1 further comprising a first insulating gap at a first gap location along the length of said first coupled subset.

19. The electrical cable of claim 18 further comprising a second insulating gap at a second gap location along the length of said second coupled subset.

20. An electrical cable comprising:

a cable substrate; and a plurality of electrical conductors bonded to said cable substrate and being spaced apart from neighboring ones of said electrical conductors to form a ribbon, said electrical conductors being electrically insulated from said respective neighboring ones, a subset of said electrical conductors being electrically coupled to one another, said ribbon being folded to form cable assembly, each of said electrical conductors traversing the width of said cable assembly at least twice;

wherein said subset of said electrical conductors is electrically coupled at a first end of said cable assembly to produce a first coupled subset leaving an uncoupled remainder of said electrical conductors, and said uncoupled remainder of said electrical conductors is electrically coupled at a second end of said cable assembly to produce a second coupled subset; and wherein members of said first coupled subset have different respective lengths, and members of said second coupled subset have lengths in correspondence with said different respective lengths of said members of said first coupled subset.

21. The electrical cable of claim 20 wherein said electrical conductors do not describe spirals around said cable assembly.

22. The electrical cable of claim 20 wherein said act of folding said ribbon comprises bending said ribbon to form a corner.

23. The electrical cable of claim 20, said cable assembly being folded lengthwise.

24. The electrical cable of claim 20 further comprising a bonding layer disposed on said ribbon, said bonding layer being optionally electrically insulating.

25. The electrical cable of claim 20 wherein said cable substrate is electrically insulating.

26. The electrical cable of claim 20 wherein each of said plurality of electrical conductors has a non-rectangular cross section.

27. The electrical cable of claim 20 wherein said first end and said second end are at opposite ends of said cable assembly.

28. The electrical cable of claim 20 further comprising a first insulating gap at a first gap location along the length of said first coupled subset.

29. The electrical cable of claim 28 further comprising a second insulating gap at a second gap location along the length of said second coupled subset.

30. The electrical cable of claim 20 wherein plurality of electrical conductors are bonded to opposite faces of said cable substrate.

31. The electrical cable of claim 20 wherein said electrical conductors are disposed on an outer surface of said cable assembly.

32. The electrical cable of claim 20 further comprising an insulating strip, said ribbon being folded around said insulating strip.

33. The electrical cable of claim 20 wherein said plurality of electrical conductors form diagonal patterns.

34. The electrical cable of claim 33 wherein:

said diagonal patterns are formed on opposite faces of said cable substrate, opposite face pairs of said electrical conductors being electrically coupled at edges of said cable substrate.

35. The electrical cable of claim 33 wherein:

said diagonal patterns are formed on opposite faces of said cable substrate, said opposite faces of said cable substrate and said electrical conductors having coupling holes therethrough, opposite face pairs of said electrical conductors being electrically coupled through said coupling holes.

36. The electrical cable of claim 20 wherein said plurality of electrical conductors comprise an electrically conducting ink.

* * * * *